US008915664B2

(12) United States Patent
Lu

(10) Patent No.: US 8,915,664 B2
(45) Date of Patent: Dec. 23, 2014

(54) COMPLETE EXHAUSTION TYPE LIPSTICK TUBE

(76) Inventor: Huiping Lu, Shanghai (CN)

( * ) Notice: Subject to any disclaimer, the term of this patent is extended or adjusted under 35 U.S.C. 154(b) by 412 days.

(21) Appl. No.: 13/393,043

(22) PCT Filed: Nov. 23, 2009

(86) PCT No.: PCT/CN2009/075081

§ 371 (c)(1),
(2), (4) Date: Feb. 28, 2012

(87) PCT Pub. No.: WO2011/026279

PCT Pub. Date: Mar. 10, 2011

(65) Prior Publication Data

US 2012/0163895 A1 Jun. 28, 2012

(30) Foreign Application Priority Data

Sep. 2, 2009 (CN) ..... 2009 1 0195027

(51) Int. Cl.
*B43K 21/08* (2006.01)
*A45D 40/06* (2006.01)

(52) U.S. Cl.
CPC ..... *A45D 40/06* (2013.01)
USPC ..... 401/78; 401/77

(58) Field of Classification Search
CPC ..... A45D 40/06
USPC ..... 401/68, 75, 78; 206/385
See application file for complete search history.

(56) References Cited

U.S. PATENT DOCUMENTS 2,720,966 A * 10/1955 Davis ..... 401/78
7,637,371 B2 * 12/2009 Kang ..... 206/385
2006/0099024 A1 * 5/2006 Demellier et al. ..... 401/75

* cited by examiner

*Primary Examiner* — David Walczak
*Assistant Examiner* — Jennifer C Chiang

(57) ABSTRACT

A lipstick tube has an outer-layer spiral tube, a middle-layer involution tube and a lipstick cup arranged on the inner side sequentially sheathed on the inner side of a base, and a longitudinal groove is arranged on the tube wall of the middle-layer involution tube. The lipstick cup has a vertical groove on the cup wall. A first lifting point is arranged directly under the vertical groove, engaged with the longitudinal groove of the middle-layer involution tube and the internal thread of the outer-layer spiral tube; a second lifting point is arranged on the outer surface of a base plate, engaged with the vertical groove, the longitudinal groove and the internal thread. The outer-layer spiral tube allows the first and the second lifting points to move side by side. The internal thread of the upper-section spiral tube only allows the second lifting point to move.

8 Claims, 5 Drawing Sheets

COMPLETE EXHAUSTION TYPE LIPSTICK TUBE

TECHNICAL FIELD

The invention relates to a packaging container of lipstick, belongs to the field of packaging of cosmetics and particularly relates to a complete exhaustion type lipstick tube which can make fullest use of the lipstick.

BACKGROUND OF THE INVENTION

All lipsticks are fixed in the following way so far: a lipstick body which is near to ⅓ of the full length of one lipstick is directly inserted into a fixed cup positioned on the innermost layer of a lipstick tube, by relatively rotating an outer-layer spiral tube and a middle-layer involution tube (as the middle-layer involution tube is positioned on the inner side of the outer-layer spiral tube, and the middle-layer involution tube cannot be in direct contact with the outer-layer spiral tube; when in use, a base which is fixed at the bottom of the middle-layer involution tube and the outer-layer spiral tube are relatively rotated). A lifting point on the fixed cup can move along the internal thread of the outer-layer spiral tube; furthermore, as the lifting point penetrates the longitudinal groove of the middle-layer involution tube, the fixed cup can move up and down during rotation so as to push out the lipstick or take the lipstick back into the middle-layer involution tube.

However, under the conventional structure, when the fixed cup is sent upward until it is flush with the tube mouth of the middle-layer involution tube and that of the outer-side spiral tube, the fixed cup cannot ascend any more, namely this place is the highest point of the fixed cup. Although the upper-section lipstick, which is exposed on the cup mouth of the fixed cup, can be completely pushed out, about ⅓ of the lipstick, which is inserted into the fixed cup, cannot be pushed out further and cannot be used; in other words, each lipstick must discard about ⅓ of the lipstick.

SUMMARY OF THE INVENTION

The invention aims at providing a complete exhaustion type lipstick tube which can further push out lipstick on the inner side of a fixed cup after the lipstick exposed on the fixed cup is exhausted while not changing the appearance shape and the basic size of the existing lipstick tube.

The technical scheme adopted by the invention for solving the technical problem is as follows: a complete exhaustion type lipstick tube comprises a base and a cover body, wherein the cover body is detachably buckled on the base, an outer-layer spiral tube with an internal thread, a middle-layer involution tube with a longitudinal groove and a fixed cup arranged on the inner side for setting lipstick, are sequentially sheathed on the inner side of the base from outside to inside, the outer-layer spiral tube and the middle-layer involution tube can rotate relatively, the bottom of the middle-layer involution tube is fixed in the base, and the fixed cup can move up and down along the middle-layer involution tube during rotation, wherein, the fixed cup is a separated fixed cup and formed by sheathing the cup wall on the outer side and the base plate on the inner side, wherein, a vertical groove is arranged on the cup wall and the tube wall, a first lifting point is arranged under the vertical groove, and the first lifting point penetrates the longitudinal groove of the middle-layer involution tube and is embedded in the internal thread of the outer-layer spiral tube;

a second lifting point is arranged on the outer surface of the base plate, the second lifting point penetrates the vertical groove of the cup wall and the longitudinal groove of the middle-layer involution tube and is embedded in the internal thread of the outer-layer spiral tube, the second lifting point is longitudinally stacked with the first lifting point of the cup wall at the bottom of the vertical groove of the cup wall and can move up and down along the vertical groove, and a lipstick fixing part is arranged on the base plate;

the outer-layer spiral tube is divided into an upper section and a lower section, the width of the internal thread of the lower-section spiral tube is sufficient to enable the first lifting point and the second lifting point, which are longitudinally stacked, to move side by side, and the width of the internal thread of the upper-section spiral tube can only enable the second lifting point to move alone.

By relatively rotating the lower-section spiral tube and the middle-layer involution tube, the first lifting point of the cup wall and the second lifting point of the base plate can ascend simultaneously along the longitudinal groove on the middle-layer involution tube, the fixed cup is upwardly pushed out of the inside of the middle-layer involution tube after the second lifting point is sent into the inlet of the internal thread of the upper-section spiral tube, as the width of the internal thread of the upper-section spiral tube can only enable one lifting point to enter, the first lifting point cannot ascend any more and stays at the top of the internal thread of the lower-section spiral tube, and then the fixed cup achieves the highest point; by further relatively rotating the upper-section spiral tube and the middle-layer involution tube, the second lifting point of the base plate can ascend along the vertical groove of the cup wall, the base plate is upwardly pushed out of the inside of the cup wall, and then the lipstick in the fixed cup can be completely pushed out.

The structural principle of the invention is as follows:

The original integrated type lipstick fixed cup is changed to the split type, namely the fixed cup is divided into the cup wall and the base plate, and the lipstick is fixed in the space constituted by the cup wall and the base plate at the bottom on the inner side of the cup wall; simultaneously, the original integrated type outer-layer spiral tube is also changed to the two-section type, namely the spiral tube is divided into the upper-section spiral tube and the lower-section spiral tube.

There are many forms for fixing the middle-layer involution tube and the base, such as step form, or buckle form, or bonding form and the like, and the premise is that the two can be fixed together.

At the beginning of use, the lower-section spiral tube and the middle-layer involution tube (the base) are rotated relatively, the cup wall and the base plate do not move relatively, but rotate and ascend or descend as a whole along the middle-layer involution tube like an ordinary fixed cup. The first lifting point on the outer side of the cup wall is arranged below the vertical groove, namely the bottom of the cup wall, when the fixed cup ascends to the joint between the upper-section spiral tube and the lower-section spiral tube, as the width of the internal thread of the upper-section spiral tube can only enable one lifting point (the second lifting point of the base plate) to enter, the first lifting point of the cup wall stays at the top of the internal thread of the lower-section spiral tube and cannot ascend any more; when the lipstick is used continuously, the upper-section spiral tube and the middle-layer involution tube (the base) are relatively rotated, the cup wall and the base plate start to move relatively, and the base plate ascends or descends along the vertical groove of the cup wall so as to further push out the effective part of the lipstick in the fixed cup until the effective part of the lipstick is completely pushed out and used. On the basis of the above scheme, in order to ensure that the outer-side spiral tube cannot be drawn out due to the two-section type structure, a fixing groove is arranged on the upper edge of the inner wall of the upper-section spiral tube, a fixing point in the corresponding position is arranged on the upper edge of the periphery of the middle-layer involution tube, and the fixing point is embedded in the fixing groove so as to position the upper-section spiral tube and simultaneously position the lower-section spiral tube at the lower part.

A plurality of the positioning forms can be adopted, for example, a flange with T-shaped section is formed on the upper edge of the middle-layer involution tube, so that the upper-section spiral tube and the lower-section spiral tube are clamped between the flange and the base, and the positioning of the outer-layer spiral tube can also be realized.

In addition, transverse grooves in the reverse directions are formed at the two ends of the longitudinal groove of the middle-layer involution tube, the whole is in the shape of a Z, and the arrangement of the transverse grooves can leave a margin for movement of the lifting points so as to actually position the lipstick at the highest point or the lowest point and ensure the structural stability in the position. It should be noted that the height of the transverse groove at the lower end of the longitudinal groove can enable the first lifting point and the second lifting point to move side by side, and the height of the transverse groove at the upper end of the longitudinal groove can only enable the second lifting point to move alone.

On the basis of the above scheme, in the outer-layer spiral tube, the slope of the internal thread of the lower-section spiral tube is greater than that of the internal thread of the upper-section spiral tube. The different slopes can control the speed of pushing out the lipstick, when the lipstick exposed on the fixed cup is used up and the residual lipstick in the fixed cup is pushed out, as the slope of the internal thread of the upper-section spiral tube is smaller, the speed of turning up the lipstick in the fixed cup is slowed down and the stability during the use can still be ensured.

On the basis of the above scheme, the first lifting point is next to the lower part of the vertical groove on the cup wall, the second lifting point of the base plate is arranged in the vertical groove, the first and the second lifting points are longitudinally closely stacked, when the fixed cup is positioned in the highest point on the cup wall, the boundary between the upper-section spiral tube and the lower-section spiral tube is arranged at the tangential line between the first lifting point and the second lifting point.

In the fixed cup, the diameter of the first lifting point of the cup wall is the same with that of the second lifting point of the base, and the center of the circle of the first lifting point and the center of the circle of the second lifting point are positioned on the same vertical line, thereby facilitating joint ascending or descending of the first lifting point and the second lifting point in the longitudinal groove of the middle-layer involution tube.

On the basis of the scheme, in order to facilitate processing and enable the lifting points to move freely in the vertical groove and the longitudinal groove, the width of the vertical groove of the cup wall is equivalent to that of the longitudinal groove of the middle-layer involution tube, and is matched with the diameter of the first lifting point and the diameter of the second lifting point.

On the basis of the above scheme, the lipstick fixing part on the base plate is a semi-ellipsoid and the lipstick is embedded on the inner side of the fixed cup and positioned by the semi-ellipsoid. The lipstick fixing part can adopt various forms and can also be in the shape of a mushroom, or a semi-ellipse with a platform at the bottom, or a rounded three-edged or four-edged olive and the like, and the lipstick fixing part has no taper angles or edge angles and cannot only stabilize the lipstick, but also completely exhaust the last lipstick attached on the fixing part in an actual and convenient manner no matter which angle is adopted when the lipstick in the fixed cup is almost completely exhausted.

On the basis of the above scheme, the height of the base plate is ⅓ of the overall height of the fixed cup.

The invention has the following benefits:

The lipstick tube of the invention changes the original integrated type fixed cup into the split type. The integrated type outer-layer spiral tube is changed to the two-section type. The structure is reliable. The two-section type rotation is adopted. The action of the lower-section spiral tube is not different from the ordinary lipstick spiral tube. The upper-section spiral tube is used for turning up the base plate of the fixed cup when the lipstick exposed on the fixed cup is exhausted. The lipstick on the inner side of the fixed cup can be further pushed out for use so as to achieve the complete exhaustion effect.

DESCRIPTION OF REFERENCE SIGNS

Figure 1A:
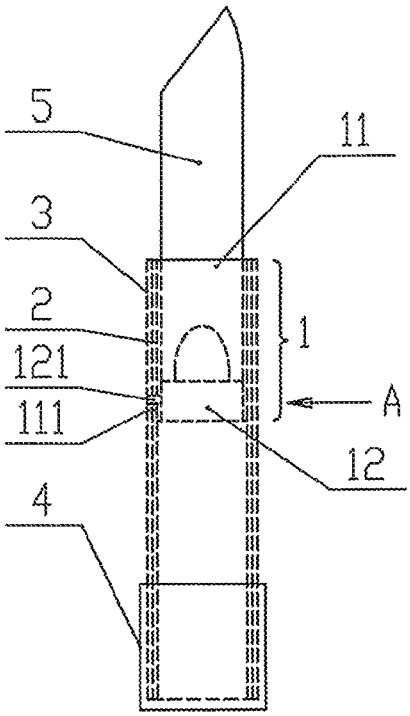
FIG. 1A is a schematic diagram of an assembly structure of the invention.

| | | |
|---|---|---|
| 1—fixed cup | | |
| 11—cup wall | 111—first lifting point | 112—vertical groove |
| 12—base plate | 121—second lifting point | 122—lipstick fixing part |
| 2—middle-layer involution tube | 21—longitudinal groove | 22—fixing point |
| 3—outer-layer spiral tube | | |
| 31—upper-section spiral tube | 311—internal thread | 312—positioning groove |

-continued

| | | |
|---|---|---|
| 32—lower-section spiral tube | 321—internal thread | |
| A—boundary | 4—base | 5—lipstick |

DETAILED DESCRIPTION OF THE INVENTION

In combination with the figures, the structure of the invention is further described. As shown in FIGS. 1A to 11, a complete exhaustion type lipstick tube comprises a base 4 and a cover body (which is not shown in the figures), wherein the cover body is detachably buckled on the base 4, an outer-layer spiral tube 3 with internal thread, a middle-layer involution tube 2 with a longitudinal groove 21 and a fixed cup 1 arranged on the inner side for setting lipstick 5, are sequentially sheathed on the inner side of the base 4 from outside to inside, the outer-layer spiral tube 3 and the middle-layer involution tube 2 can rotate relatively, the bottom of the middle-layer involution tube 2 is fixed in the base 4, and the fixed cup 1 can move up and down along the middle-layer involution tube 2 during rotation.

The fixed cup 1 is a separated fixed cup and formed by sheathing the cup wall 11 on the outer side and the base plate 12 on the inner side, wherein, a vertical groove 112 is arranged on the cup wall 11 and the tube wall. A first lifting point 111 is arranged directly under the vertical groove 112 by being next to the vertical groove 112, and the first lifting point 111 penetrates the longitudinal groove 21 of the middle-layer involution tube 2 and is embedded in the internal thread of the outer-layer spiral tube 3. The height of the base plate 12 is ⅓ of the overall height of the fixed cup 1. A second lifting point 121 is arranged on the outer surface of the base plate 12. The second lifting point 121 penetrates the vertical groove 112 of the cup wall 11 and the longitudinal groove 21 of the middle-layer involution tube 2 and is embedded in the internal thread of the outer-layer spiral tube 3.

In the fixed cup 1, the second lifting point 121 is longitudinally stacked with the first lifting point 111 of the cup wall 11 at the bottom of the vertical groove 112 of the cup wall and can move up and down along the vertical groove 112. A lipstick fixing part 122 is arranged at the middle part of the base plate 12 and is a semi-ellipsoid, and the lipstick 5 is embedded on the inner side of the fixed cup 1 and positioned by the semi-ellipsoid.

The diameter of the first lifting point 111 of the cup wall 11 is the same as that of the second lifting point 121 of the base 12, and the center of the circle of the first lifting point 111 and the center of the circle of the second lifting point 121 are positioned on the same vertical line. The width of the vertical groove 112 of the cup wall 11 is equivalent to that of the longitudinal groove 21 of the middle-layer involution tube 2, and the width of the vertical groove 112 of the cup wall 11 is matched with the diameter of the first lifting point 111 and the diameter of the second lifting point 121.

The outer-layer spiral tube 3 is divided into an upper section and a lower section, when the fixed cup 1 is positioned at the highest point, and the first lifting point 111 of the cup wall 11 is longitudinally closely stacked with the second lifting point 121 of the base plate 12. The boundary A between the upper-section spiral tube 31 and the lower-section spiral tube 32 is arranged at the tangential line between the first lifting point 111 and the second lifting point 121, wherein, a fixing groove 312 is arranged on the upper edge of the inner wall of the upper-section spiral tube 31, a fixing point 22 in the corresponding position is arranged on the upper edge of the periphery of the middle-layer involution tube 2, and the fixing point 22 is embedded in the fixing groove 312 so as to position the upper-section and the lower-section spiral tubes 31, 32. The width of the internal thread 321 of the lower-section spiral tube 32 is sufficient to enable the first lifting point 111 and the second lifting point 121, which are longitudinally stacked, to move simultaneously, and the width of the internal thread 311 of the upper-section spiral tube 31 can only enable the second lifting point 121 to move alone.

The slope of the internal thread 321 of the lower-section spiral tube is greater than that of the internal thread 311 of the upper-section spiral tube.

Figure 1B:
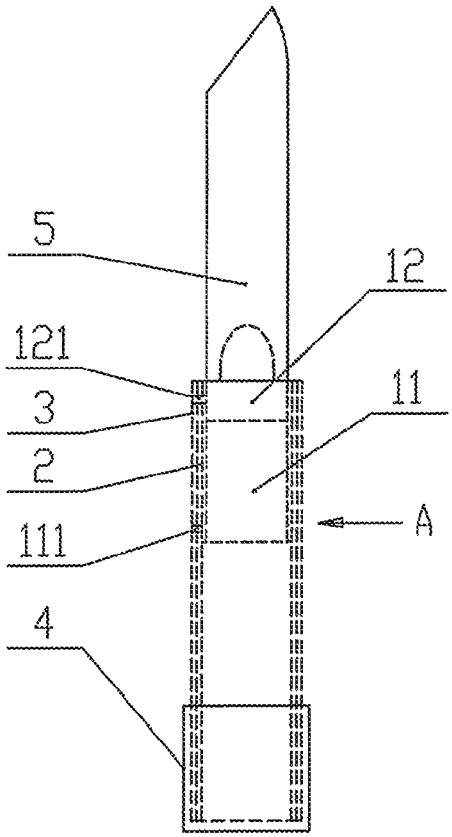
FIG. 1B is a schematic diagram of the assembly structure of the invention showing the base plate 12 being at a different position.
Figure 2:
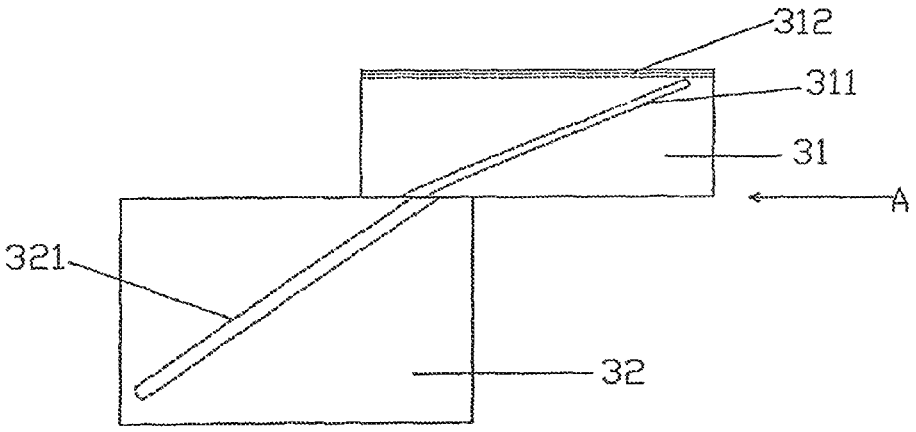
FIG. 2 is a schematic diagram of an unfolded structure of an outer-layer spiral tube of the invention.
Figure 3:
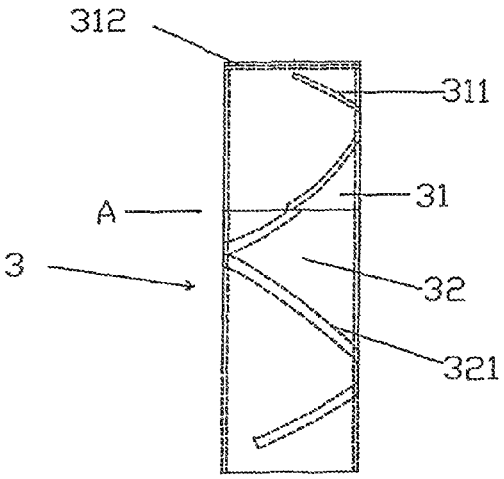
FIG. 3 is a schematic diagram of a three-dimensional structure of an outer-layer spiral tube of the invention.
Figure 4:
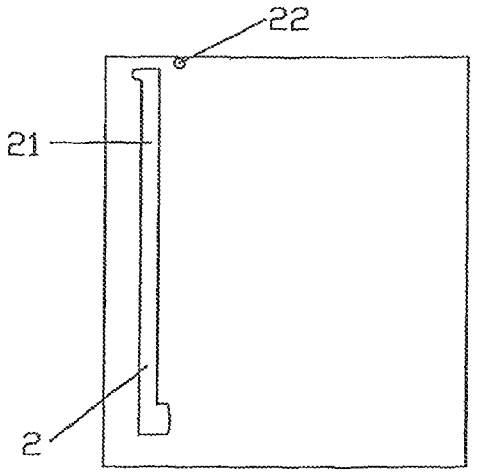
FIG. 4 is a schematic diagram of a three-dimensional structure of a middle-layer involution tube of the invention.
Figure 5:
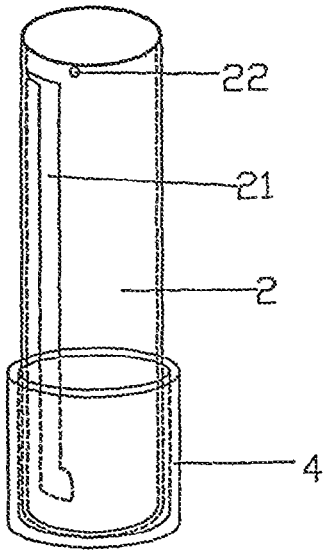
FIG. 5 is a schematic diagram of a three-dimensional structure of a mounting of middle-layer involution tube and base of the invention.
Figure 6:
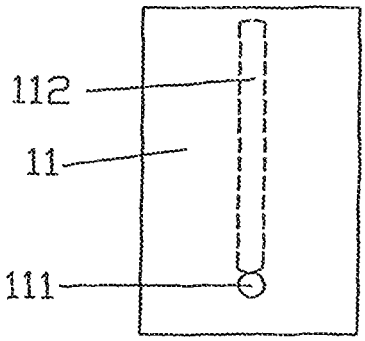
FIG. 6 is a schematic diagram of a main view structure of a cup wall of the invention.
Figure 7:
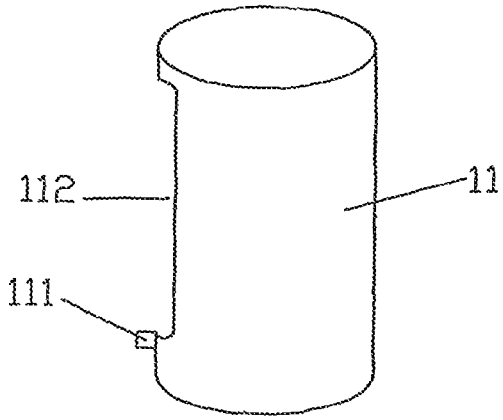
FIG. 7 is a schematic diagram of a three-dimensional structure of a cup wall of the invention.
Figure 8:
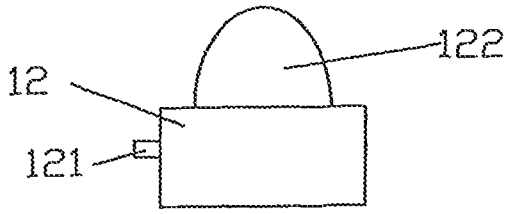
FIG. 8 is a schematic diagram of a main view structure of a base plate of the invention.
Figure 9:
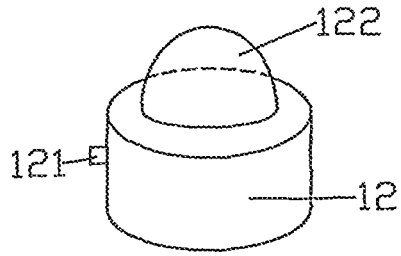
FIG. 9 is a schematic diagram of a three-dimensional structure of a base plate of the invention.
Figure 10:
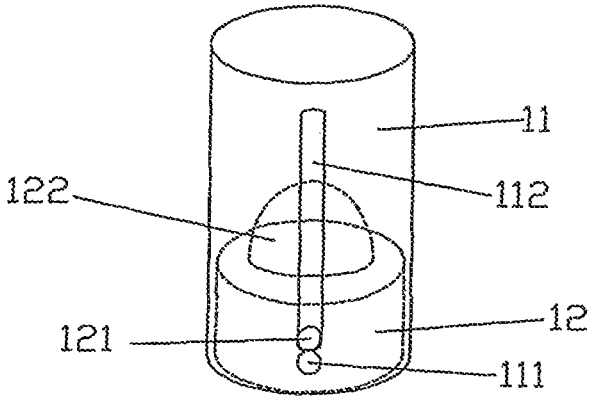
FIG. 10 is a stereogram of an assembly structure of a fixed cup of the invention.
Figure 11:
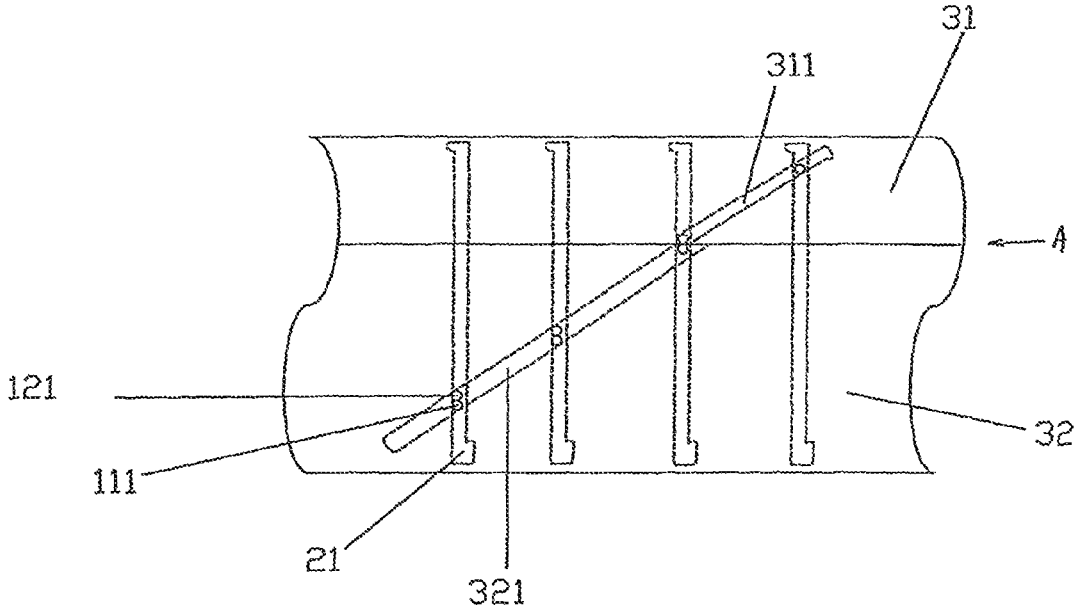
FIG. 11 is a diagram of the moving process of lifting points in the operation of the invention.

By relatively rotating the lower-section spiral tube 32 and the middle-layer involution tube 2 (the base 4), the first lifting point 111 of the cup wall 11 and the second lifting point 121 of the base plate 12 can ascend simultaneously along the longitudinal groove 21 on the middle-layer involution tube 2. The fixed cup 1 is upwardly pushed out of the inside of the middle-layer involution tube 2 until the second lifting point 121 is sent into the inlet of the internal thread 311 of the upper-section spiral tube 31, as the width of the internal thread 311 of the upper-section spiral tube 31 can only enable one lifting point (the second lifting point 121) to enter, the first lifting point 111 stays at the top of the internal thread 321 of the lower-section spiral tube 32 and cannot ascend any more, and then the fixed cup 1 achieves the highest point. By further relatively rotating the upper-section spiral tube 31 and the middle-layer involution tube 2, the second lifting point 121 of the base plate 12 can ascend along the vertical groove 112 of the cup wall 11 and the longitudinal groove 21 of the middle-layer involution tube 2, and the base plate 12 is upwardly pushed to the top portion of the inside of the cup wall 11 as shown in FIG. 1B.

What is claimed is:

1. A complete exhaustion type lipstick tube, comprising a base, an outer-layer spiral tube with internal thread, a middle-layer involution tube with a longitudinal groove, and a fixed cup arranged on the inner side for setting lipstick, are sequentially sheathed on the inner side of the base from outside to inside, the outer-layer spiral tube and the middle-layer involution tube can rotate relatively, the bottom of the middle-layer involution tube is fixed in the base, the fixed cup can move up and down along the middle-layer involution tube during rotation, wherein the fixed cup is a separated fixed cup and formed by sheathing a cup wall on the outer side and the base plate on the inner side, wherein, a vertical groove is arranged on the cup wall a first lifting point is arranged directly under the vertical groove, and the first lifting point penetrates the longitudinal groove of the middle-layer involution tube and is embedded in an internal thread of the outer-layer spiral tube;

a second lifting point is arranged on the outer surface of the base plate, the second lifting point penetrates the vertical groove of the cup wall and a longitudinal groove of the middle-layer involution tube and is embedded in the internal thread of the outer-layer spiral tube, the second lifting point is longitudinally stacked with the first lifting point of the cup wall at the bottom of the vertical groove of the cup wall and can move up and down along the vertical groove, and a lipstick fixing part is arranged on the base plate;

the outer-layer spiral tube is divided into an upper section and a lower section, the width of the internal thread of the lower-section spiral tube is sufficient to enable the first lilting point and the second lifting point, which are longitudinally stacked, to move side by side, and the width of the internal thread of the upper-section spiral tube can only enable the second lifting point to move alone;

by relatively rotating the lower-section spiral tube and the middle-layer involution tube, the first lifting point of the cup wall and the second lifting point of the base plate can ascend simultaneously along the longitudinal groove on the middle-layer involution tube, the fixed cup is upwards pushed out of the inside of the middle-layer involution tube till the second lifting point is sent into an inlet of the internal thread of the upper-section spiral tube, then the first lifting point stays at the top of the internal thread of the lower-section spiral tube, and then the fixed cup achieves the highest point; by further relatively rotating the upper-section spiral tube and the middle-layer involution tube, the second lifting point of the base plate can ascend along the vertical groove of the cup wall, and then the base plate is upwards pushed to a top portion of the inside of the cup wall.

2. The complete exhaustion type lipstick tube according to claim 1, wherein a fixing groove is arranged on the upper edge of the inner wall of the upper-section spiral tube, a fixing point in the corresponding position is arranged on the upper edge of the periphery of the middle-layer involution tube, and the fixing point is clamped in the fixing groove so as to position the upper-section spiral tube.

3. The complete exhaustion type lipstick tube according to claim 1, wherein, in the outer-layer spiral tube, a slope of the internal thread of the lower-section spiral tube is greater than that of the internal thread of the upper-section spiral tube.

4. The complete exhaustion type lipstick tube according to claim 1, wherein the first lifting point is next to the lower part of the vertical groove on the cup wall, the second lifting point of the base plate is arranged in the vertical groove, the first and the second lifting points are longitudinally closely stacked, when the fixed cup is positioned in the highest point on the cup wall, the boundary between the upper-section spiral tube and the lower-section spiral tube is arranged at the tangential line between the first lifting point and the second lifting point.

5. The complete exhaustion type lipstick tube according to claim 1, wherein, in the fixed cup, the diameter of the first lifting point of the cup wall is the same with that of the second lifting point of the base, and the center of the circle of the first lifting point and the center of the circle of the second lifting point are positioned on the same vertical line.

6. The complete exhaustion type lipstick tube according to claim 5, wherein the width of the vertical groove of the cup wall is equivalent to that of the longitudinal groove of the middle-layer involution tube, and the width of the vertical groove of the cup wall is matched with the diameter of the first lifting point and the diameter of the second lifting point.

7. The complete exhaustion type lipstick tube according to claim 1, wherein the lipstick fixing part on the base plate is a semi-ellipsoid and the lipstick is embedded on the inner side of the fixed cup and positioned by the semi-ellipsoid.

8. The complete exhaustion type lipstick tube according to claim 1, wherein the height of the base plate is ⅓ of the overall height of the fixed cup.

* * * * *